US011278075B1

(12) United States Patent
Wood et al.

(10) Patent No.: US 11,278,075 B1
(45) Date of Patent: Mar. 22, 2022

(54) HEADWEAR WITH AIRFLOW VISOR

(71) Applicant: Outdoor Cap Co., Inc., Bentonville, AR (US)

(72) Inventors: Michele Wood, Lowell, AR (US); Alyssa Graves, Bentonville, AR (US); Jeremy Jackson, Rogers, AR (US)

(73) Assignee: OUTDOOR CAP CO., INC., Bentonville, AR (US)

( * ) Notice: Subject to any disclaimer, the term of this patent is extended or adjusted under 35 U.S.C. 154(b) by 218 days.

(21) Appl. No.: 16/666,628

(22) Filed: Oct. 29, 2019

Related U.S. Application Data

(60) Provisional application No. 62/753,592, filed on Oct. 31, 2018.

(51) Int. Cl.
*A42B 1/008* (2021.01)
*A42B 1/0183* (2021.01)
*A42B 1/0182* (2021.01)

(52) U.S. Cl.
CPC ..... *A42B 1/008* (2013.01); *A42B 1/0182* (2021.01); *A42B 1/0183* (2021.01)

(58) Field of Classification Search
CPC ..... A42B 1/008; A42B 1/0182; A42B 1/0183
See application file for complete search history.

(56) References Cited

U.S. PATENT DOCUMENTS 1,569,658 A * 1/1926 Levinson ..... A42B 1/0182 2/10
2,769,308 A * 11/1956 Krasno ..... A42C 5/02 2/171.2
3,766,565 A * 10/1973 Cozzens ..... A42B 1/06 2/209.7
4,292,689 A * 10/1981 Townsend, Jr. ..... A42B 1/0182 2/12
4,549,316 A * 10/1985 Johnson ..... A42B 1/0182 2/195.1
4,790,034 A * 12/1988 Pass ..... A42B 1/0181 2/195.5
4,831,665 A * 5/1989 Palmaer ..... A61F 9/02 2/9
5,305,470 A * 4/1994 McKay ..... A41D 20/005 2/170
5,327,585 A * 7/1994 Karlan ..... A42B 1/008 2/171.2
5,487,191 A * 1/1996 Ridley ..... A42C 5/04 2/195.1
5,581,808 A * 12/1996 Garza ..... A42B 1/0182 2/12
6,023,788 A * 2/2000 McCallum ..... A42B 1/241 2/181

(Continued)

*Primary Examiner* — Khaled Annis

(74) *Attorney, Agent, or Firm* — Head, Johnson, Kachigian & Wikinson, PC

(57) ABSTRACT

Headwear with airflow visor. The headwear includes a crown with a head receiving portion configured to be receivable on a head of a user. A sweatband extends along at least a portion of an inner edge of the head receiving portion of the crown. A brim or visor extends outwardly from a lower edge of the crown adjacent the sweatband. A plurality of vent channels through the brim permit and encourage passage of air from above the brim, through the brim, toward the sweatband and toward a forehead of the user.

12 Claims, 3 Drawing Sheets

(56) References Cited

U.S. PATENT DOCUMENTS

| | | | | |
|---|---|---|---|---|
| 6,408,443 | B1 * | 6/2002 | Park | A61F 9/045 2/195.1 |
| 2004/0006807 | A1 * | 1/2004 | Wang | A42C 5/04 2/195.1 |
| 2004/0231033 | A1 * | 11/2004 | Cho | A42B 1/0182 2/195.1 |
| 2005/0155135 | A1 * | 7/2005 | Cho | A42B 1/22 2/172 |
| 2006/0277951 | A1 * | 12/2006 | Herr | D04B 21/12 66/196 |
| 2008/0140165 | A1 * | 6/2008 | Cohen | A61F 7/02 607/108 |
| 2009/0049578 | A1 * | 2/2009 | Toyohiro | A61F 9/045 2/69 |
| 2013/0263358 | A1 * | 10/2013 | Fleischmann | A42B 1/008 2/182.8 |
| 2017/0215513 | A1 * | 8/2017 | Crunk | A42C 5/04 |
| 2018/0055104 | A1 * | 3/2018 | Yeung | A42B 1/22 |
| 2019/0150551 | A1 * | 5/2019 | Clark | A42C 5/04 |

* cited by examiner

HEADWEAR WITH AIRFLOW VISOR

CROSS REFERENCE

This application claims priority to and the benefit of U.S. Provisional Patent Application Ser. No. 62/753,592, filed Oct. 3, 2018, which is incorporated herein in its entirety by reference.

BACKGROUND OF THE INVENTION

Field of the Invention

The present invention is directed to headwear, such as a cap or hat, with an airflow visor wherein a brim or visor extends outwardly from a lower edge of a crown adjacent a sweatband along an inner edge of the crown. A plurality of vent channels through the brim permit and encourage passage of air from above the brim, through the brim toward the sweatband, and toward the forehead of the user.

Description of the Related Art

Headwear, such as caps and hats, often include a sweatband extending along an inner edge of the crown. Sweatbands function to provide a layer of comfort between the crown of the hat and the forehead of the user. Sweatbands also function to absorb sweat moisture from the forehead of the user. Sweatbands, however, discourage evaporation of the sweat moisture by blocking passage of air to the forehead and to the top of the head.

During elevated ambient temperatures and during strenuous activities, such as work or exercise, it is desirable for air to pass to the forehead of the user and to the sweatband of the headwear in order to enhance airflow, cooling and evaporation.

Various proposals in the past include different types of knitted fabric in order to encourage air to pass into and through the sweatband. Other proposals include incorporating an additive into the sweatband fabric to provide a cooling sensation to the user.

It would be desirable to provide headwear which encourages passage of ambient air toward the forehead of the user and toward the sweatband of the headwear in order to enhance airflow, cooling and evaporation.

It would also be desirable to provide headwear which encourages passage of ambient air through a brim or visor of the headwear toward the forehead of the user.

SUMMARY OF THE INVENTION

The present invention is directed to headwear with an airflow visor. The headwear includes a crown which may be constructed of flexible material, such as fabric.

The crown includes an open underside having an inner edge which forms a head receiving portion for a user. A sweatband extends along at least a portion of the inner edge of the head receiving portion of the crown.

A brim or visor extends outwardly at or near the lower edge of the crown adjacent the sweatband. The brim or visor includes an inner stiffener which extends somewhat radially from the head receiving portion of the crown. The inner stiffener may be surrounded on both its top and its bottom by an outer fabric cover.

The inner stiffener is secured to the crown and sweatband, such as by stitching.

A plurality of vent channels extend through the inner stiffener. The vent channels permit passage of air from above the brim, through the brim, and toward the sweatband and forehead of the user. In one embodiment, the fabric cover may cover the vent channels and the inner stiffener, although the fabric will be chosen to permit passage of air through the fabric cover and through the vent channels in the brim. Accordingly, the vent channels will not be visible. In an alternate embodiment, the fabric cover will not cover the vent channels of the inner stiffener.

Each of the vent channels expands in width as the vent channel approaches the crown and the sweatband. Each of the vent channels is arranged radially with respect to the crown so that air passes from above the brim, through the brim, under the brim, and toward the forehead and sweatband. In addition, each of the vent channels has a ramped portion or inclined surface so that air is directed toward the forehead of the user.

DETAILED DESCRIPTION OF THE INVENTION

The embodiments discussed herein are merely illustrative of specific manners in which to make and use the invention and are not to be interpreted as limiting the scope.

While the invention has been described with a certain degree of particularity, it is to be noted that many modifications may be made in the details of the invention's construction and the arrangement of its components without departing from the scope of this disclosure. It is understood that the invention is not limited to the embodiments set forth herein for purposes of exemplification.

Figure 1:
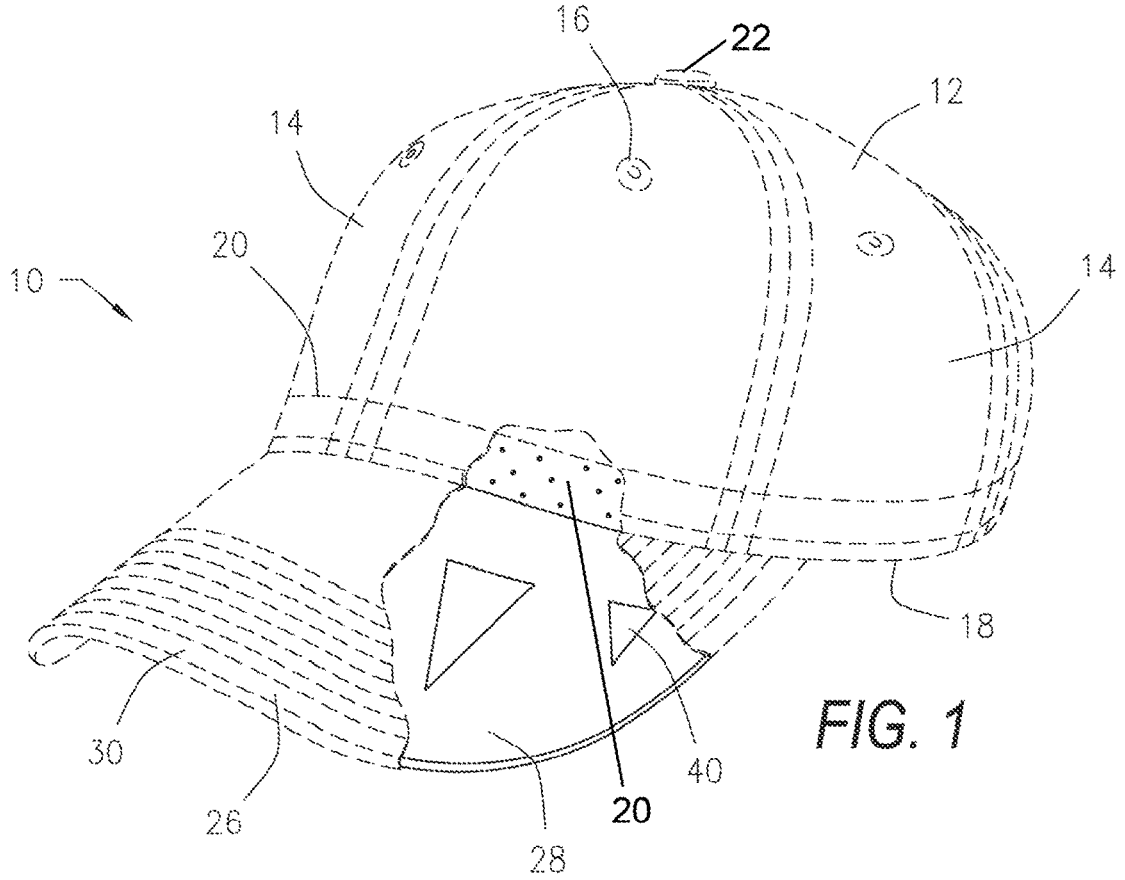
FIG. 1 illustrates a perspective view of a preferred embodiment of headwear with an airflow visor constructed in accordance with the present invention.

Referring to the drawings in detail, FIG. 1 illustrates a perspective view of a first preferred embodiment of headwear with an airflow visor 10. The headwear 10 is shown with dashed or broken lines and is partially cut away for ease of viewing. The headwear 10 includes a crown 12 which may be constructed of flexible material, such as fabric, and may be composed of a single piece or a number of panels 14 sewn together with stitching therebetween. The crown 12 may optionally include a plurality of crown vents 16 and a top button 22.

The crown 12 includes an open underside having an inner edge 18 which forms a head receiving portion for a user (not shown). A sweatband 20 extends at least along a portion of the inner edge 18 of the head receiving portion of the crown 12. In one non-limiting configuration, the sweatband 20 extends around the entire inner edge 18 of the head receiving portion. The sweatband 20 may be a knitted fabric material and may optionally include a cooling chemical additive (as shown by the dotting of the sweatband 20 in FIG. 1), such as xylitol, which is moisture activated by sweat of the user.

A brim or visor 26 extends outwardly at or near a lower edge of the crown 12 adjacent to the sweatband 20. The brim 26 may be substantially planar or be slightly curved or arched as shown in the present embodiment.

It will be appreciated that the teachings of the present invention may be applied to various styles of headwear with various styles of brims and is not limited to the particular style of headwear shown in the drawings.

As best seen in FIG. 1, the brim includes an inner stiffener 28 which extends somewhat radially from the head receiving portion of the crown 12. The inner stiffener 28 is surrounded on both its top and bottom by an outer fabric cover 30. A portion of the fabric cover 30 has been cut away for clarity. The inner stiffener 28 may extend in a plane or may be somewhat curved as desired.

Figure 2:
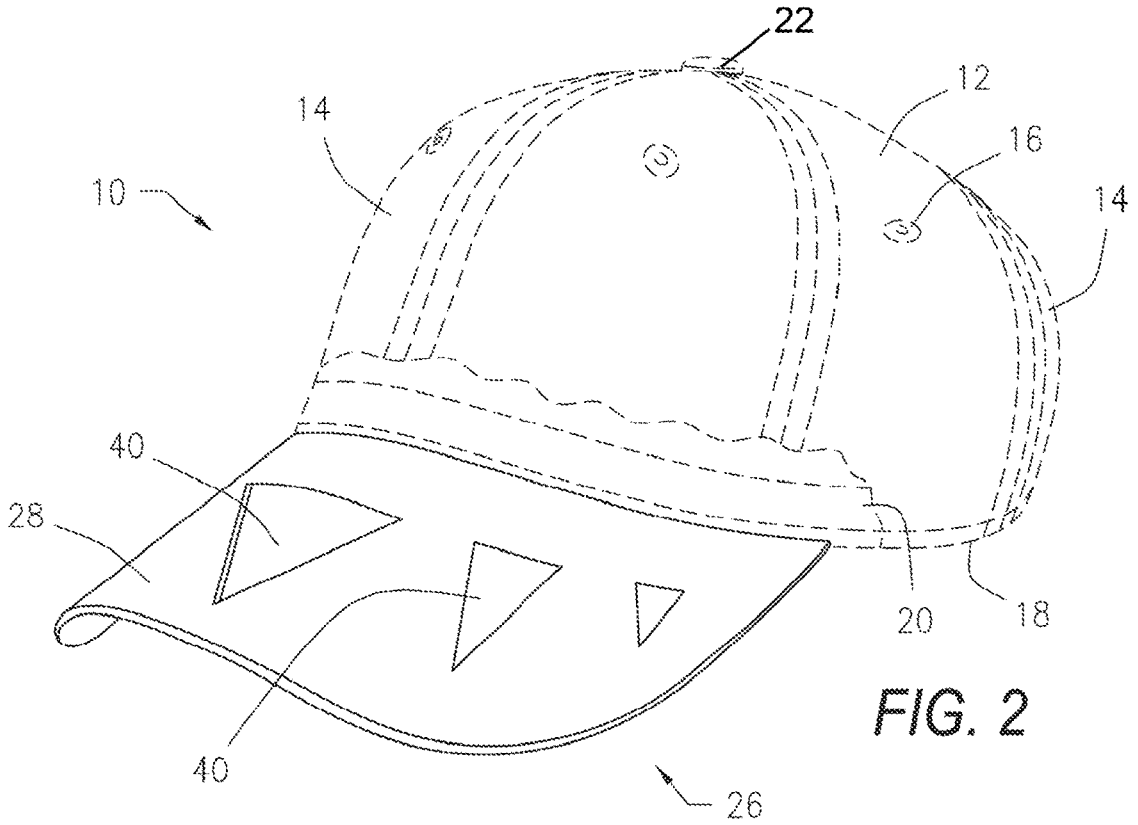
FIG. 2 illustrates a perspective view of the headwear shown in FIG. 1 with a fabric cover on a brim or visor cut away for clarity.

FIG. 2 illustrates the headwear 10 with the fabric cover 30 cut away from the brim 26 for clarity.

A plurality of vent channels 40 extend through the inner stiffener 28. The vent channels permit passage of air from above the brim 26, through the brim 26, beneath the brim 26, and toward the sweatband 20 and a forehead of the user (not shown). Accordingly, each of the vent channels 40 extends from the top of the brim 26 through to the bottom of the brim. The fabric cover 30 may cover the vent channels 40 and the brim 26, although the fabric will be chosen to permit passage of air through the fabric cover and through the vent channels 40 in the brim 26. Accordingly, the vent channels 40 will not be visible. Additionally, although the vent channels 40 will permit passage of air through the brim 26, the user will be shielded from sunlight and precipitation by the fabric cover 30.

Five vent channels 40 are provided in the brim 26 in the present embodiment, although it will be understood that a greater or lesser number may be employed within the spirit and scope of the present invention.

In an alternate embodiment (not shown), the fabric cover 30 will not cover the vent channels 40 of the inner stiffener 28.

Figure 3:
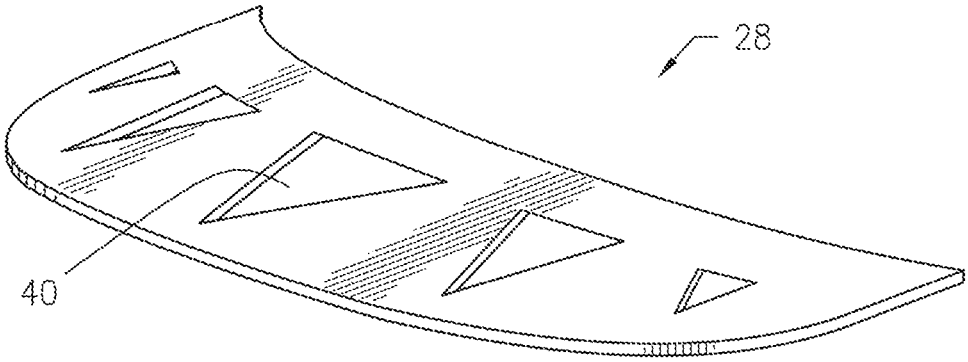
FIG. 3 illustrates a perspective view of an inner stiffener of the brim or visor apart from the headwear shown in FIGS. 1 and 2.
Figure 4:
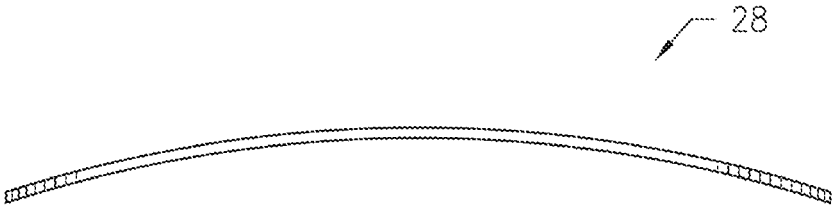
FIG. 4 illustrates a front view of the inner stiffener shown in FIG. 3.
Figure 5:
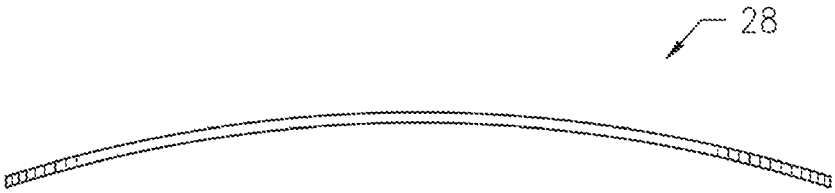
FIG. 5 illustrates a rear view of the inner stiffener shown in FIG. 3.
Figure 6:
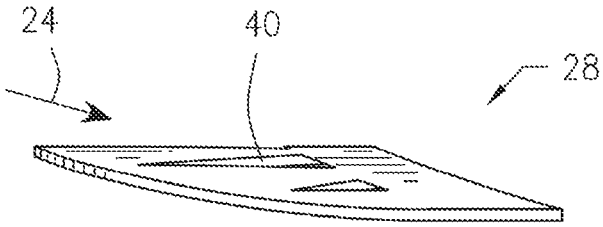
FIG. 6 illustrates a side view of the inner stiffener shown in FIG. 3.
Figure 7:
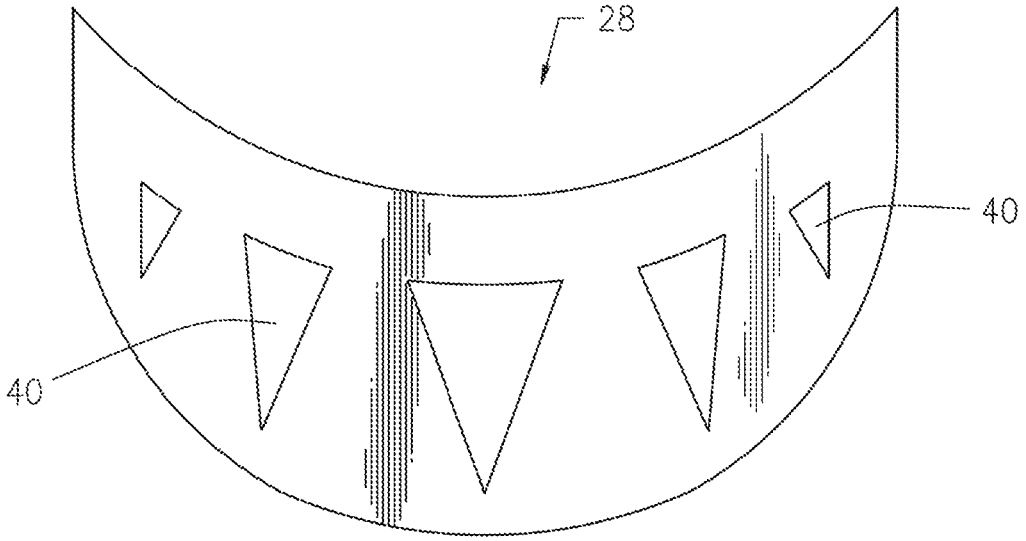
FIG. 7 illustrates a top view of the inner stiffener shown in FIG. 3.
Figure 8:
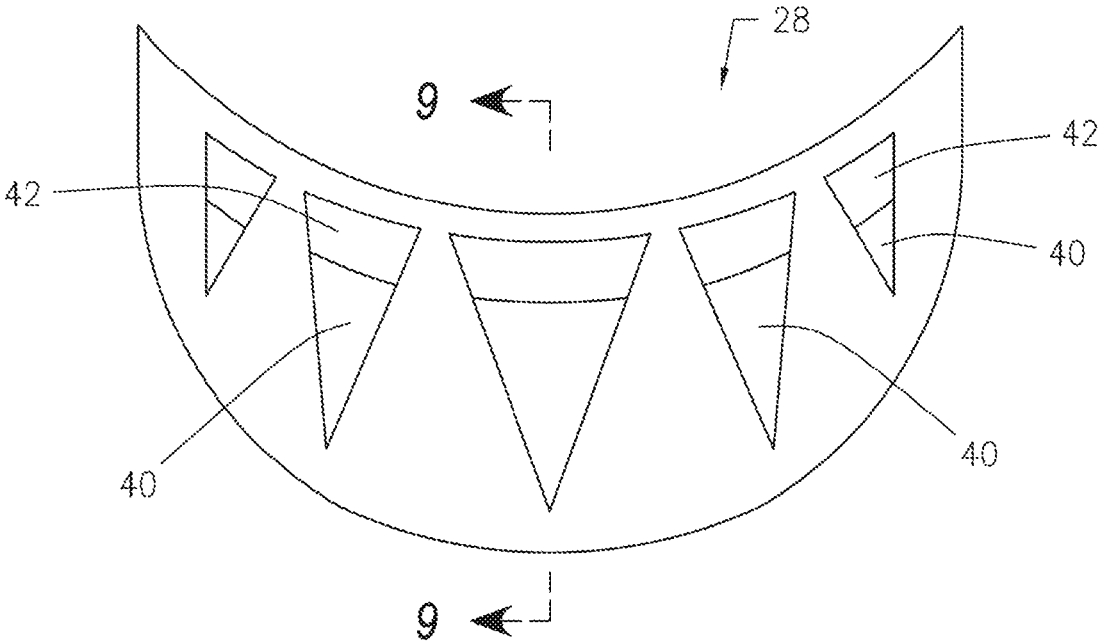
FIG. 8 illustrates a bottom view of the inner stiffener shown in FIG. 3.
Figure 9:
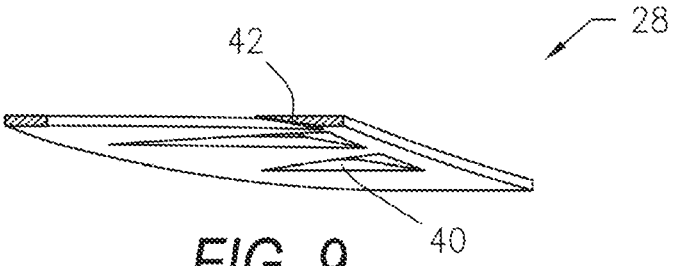
FIG. 9 illustrates a sectional view taken along section line 9-9 of FIG. 8.

FIG. 3 illustrates a perspective view of the inner stiffener 28 apart from the brim 26 and headwear 10 for clarity and ease of viewing. FIG. 4 illustrates a front view of the inner stiffener 28, FIG. 5 illustrates a rear view of the inner stiffener 28, and FIG. 6 illustrates a side view of the inner stiffener 28. FIG. 7 illustrates a top view of the inner stiffener 28, FIG. 8 illustrates a bottom view of the inner stiffener 28, and FIG. 9 illustrates a sectional view taken along section line 9-9 of FIG. 8.

As seen in FIG. 6, air moving in the direction of arrow 24 passes from above the brim 26, passes through the vent channels 40 of the brim 26, and passes toward the sweatband 20 and the forehead of the user (not shown).

The inner stiffener 28 is stitched, sewn or otherwise joined to the crown 12 and/or to the sweatband 20 of the headwear.

Each of the vent channels 40 expands in width as the vent channel approaches the crown 12 and the sweatband 20. In the embodiment shown, the vent channels 40 are triangular, although other configurations are possible.

Each of the vent channels 40 is arranged radially with respect to the crown 12 so that air passes from above the brim 26, through the vent channels 40 in the brim 26, under the brim 26, and toward the forehead and the sweatband 20. The air helps cool the forehead of the user and helps wick away moisture from the headband.

As best seen in the bottom view in FIG. 8 and in the sectional view in FIG. 9, each of the vent channels 40 has a ramped portion or inclined surface portion 42 so that air is directed toward the forehead of the user and toward the sweatband 20. The ramped portion or inclined surface portion 42 assists in directing ambient air toward the sweatband 20 and toward the forehead of the user.

The present invention provides an efficient and effective way to direct air toward the forehead of the user and toward the sweatband of the user.

Whereas, the invention has been described in relation to the drawings attached hereto, it should be understood that other and further modifications, apart from those shown or suggested herein, may be made within the scope of this invention.

What is claimed is:

1. A headwear with an airflow visor, which comprises:
- a crown with a head receiving portion configured to be receivable on a head of a user;
- a sweatband extending along at least a portion of an inner edge of said head receiving portion of said crown;
- a brim extending outwardly from a lower edge of said crown adjacent said sweatband, wherein said brim includes an inner stiffener surrounded by a fabric outer cover on both a top and a bottom of said inner stiffener;
- a plurality of vent channels through said inner stiffener for permitting passage of air through said brim toward said sweatband and toward a forehead of said user, wherein each of said plurality of vent channels includes a ramped portion configured to direct air toward said sweatband and toward said forehead of said user.

2. The headwear with an airflow visor as set forth in claim 1 wherein said inner stiffener is sewn and secured to both said sweatband and to said crown.

3. The headwear with an airflow visor as set forth in claim 1 wherein each of said plurality of vent channels is arranged radially with respect to said crown.

4. The headwear with an airflow visor as set forth in claim 1 wherein each of the plurality of vent channels expands in width as the vent channel approaches said crown.

5. The headwear with an airflow visor as set forth in claim 1 wherein said sweatband includes a cooling chemical additive activated by moisture or sweat.

6. The headwear with an airflow visor as set forth in claim 1 wherein said sweatband is a woven fabric.

7. The headwear with an airflow visor as set forth in claim 1 wherein said inner stiffener is fabricated from rigid plastic.

8. A headwear with an airflow visor, which comprises:
- a crown with a head receiving portion configured to be receivable on a head of a user;
- a sweatband extending along an inner edge of said head receiving portion of said crown;
- a brim extending outwardly from a lower edge of said crown adjacent said sweatband, wherein said brim includes an inner stiffener surrounded by a fabric outer cover on both a top and a bottom of said inner stiffener;
- a plurality of vent channels through said inner stiffener for permitting passage of air through said brim toward said sweatband and toward a forehead of said user, wherein said plurality of vent channels includes a ramped portion configured to direct air toward said sweatband and toward said forehead of said user.

9. The headwear with an airflow visor as set forth in claim 8 wherein said inner stiffener is sewn and secured to both said sweatband and to said crown.

10. The headwear with an airflow visor as set forth in claim 8 wherein each of said plurality of vent channels is arranged radially with respect to said crown.

11. The headwear with an airflow visor as set forth in claim 8 wherein each of said plurality of vent channels expands in width as the vent channel approaches said crown.

12. The headwear with an airflow visor as set forth in claim 8 wherein said sweatband includes a cooling chemical additive activated by moisture or sweat.

* * * * *